US008864965B2

(12) United States Patent
Fujikata et al.

(10) Patent No.: US 8,864,965 B2
(45) Date of Patent: Oct. 21, 2014

(54) SUBSTRATE HOLDER AND PLATING APPARATUS

(75) Inventors: Jumpei Fujikata, Tokyo (JP); Yuji Araki, Tokyo (JP); Masaaki Kimura, Tokyo (JP)

(73) Assignee: Ebara Corporation, Tokyo (JP)

( * ) Notice: Subject to any disclaimer, the term of this patent is extended or adjusted under 35 U.S.C. 154(b) by 521 days.

(21) Appl. No.: 13/211,498

(22) Filed: Aug. 17, 2011

(65) Prior Publication Data

US 2012/0043200 A1 Feb. 23, 2012

(30) Foreign Application Priority Data

Aug. 19, 2010 (JP) ..... 2010-183740
Jul. 4, 2011 (JP) ..... 2011-148077

(51) Int. Cl.

| | |
|---|---|
| ***B23H 7/26*** | (2006.01) |
| ***B25B 1/22*** | (2006.01) |
| ***B25B 1/00*** | (2006.01) |
| ***B23Q 3/02*** | (2006.01) |
| ***B23Q 3/00*** | (2006.01) |
| ***C25D 17/06*** | (2006.01) |
| ***C25D 17/00*** | (2006.01) |

(52) U.S. Cl.

CPC ..... *C25D 17/001* (2013.01); *C25D 17/06* (2013.01)

USPC ..... 204/297.01; 269/77; 269/86; 269/134; 269/287

(58) Field of Classification Search

CPC ..... C25D 17/00; C25D 17/004; C25B 9/02; C25B 17/004; C25B 17/06

USPC ..... 204/297.01, 285, 297.05; 269/86, 55, 269/77, 21, 91, 134, 287

See application file for complete search history.

(56) References Cited

U.S. PATENT DOCUMENTS 6,844,274 B2 * 1/2005 Yoshioka et al. ..... 438/800

FOREIGN PATENT DOCUMENTS

| | | |
|---|---|---|
| JP | 2003-277995 | 10/2003 |
| JP | 2004-52059 | 2/2004 |
| JP | 2004-76022 | 3/2004 |

OTHER PUBLICATIONS

Machine translation of JP 2003-277995.*
Machine translation of JP 2004-76022 A.*

* cited by examiner

*Primary Examiner* — Luan Van
*Assistant Examiner* — Alexander W Keeling
(74) *Attorney, Agent, or Firm* — Wenderoth, Lind & Ponack, L.L.P.

(57) ABSTRACT

A substrate holder includes a fixed holding member and a movable holding member for detachably holding a substrate by gripping a peripheral portion of the substrate therebetween, and an inner seal member and an outer seal member which are fixed to the movable holding member. When the substrate is held by the movable holding member and the fixed holding member, the inner and outer seal members seal the connection between the movable holding member and a peripheral portion of the substrate and the connection between the movable holding member and the fixed holding member, respectively. The movable holding member includes a seal holder, and the inner seal member and the outer seal member are fixed between the seal holder and a fixing ring secured to the seal holder.

7 Claims, 15 Drawing Sheets

SUBSTRATE HOLDER AND PLATING APPARATUS

BACKGROUND OF THE INVENTION

1. Field of the Invention

The present invention relates to a substrate holder for use in a plating apparatus for carrying out plating of a surface (front surface) to be plated of a substrate. In particular, the invention relates to a plating apparatus for forming a plated film in fine interconnect trenches and holes, or resist openings, provided in a surface of a semiconductor wafer, or for forming bumps (protruding electrodes), which are for electrical connection to, e.g., electrodes of a package, on a surface of a semiconductor wafer. The present invention also relates to a plating apparatus provided with the substrate holder.

2. Description of the Related Art

It is common practice, e.g., in TAB (tape automated bonding) or flip chip to form protruding connection electrodes (bumps) of gold, copper, solder or nickel, or of multiple layers of such metals at predetermined portions (electrodes) of a surface of a semiconductor chip, having interconnects formed therein, so that the semiconductor chip can be electrically connected via the bumps to electrodes of a package or TAB electrodes. There are various methods usable for the formation of bumps, such as electroplating, vapor deposition, printing and ball bumping. Of these, electroplating, which can form fine bumps and can be performed in a relatively stable manner, is most commonly used as the I/O number of a semiconductor chip increases and the electrode pitch becomes smaller.

Electroplating methods can be classified roughly into a jet method or cup method in which a substrate, such as a semiconductor wafer, is held in a horizontal position with a surface to be plated facing downwardly, and a plating solution is jetted upwardly onto the surface to be plated, and a dip method in which a substrate is held in a vertical position in a plating tank, and a plating solution is injected upwardly into the plating tank and the plating solution is allowed to overflow the plating tank during plating. Electroplating using a dip method has the advantages of a small footprint and good release of bubbles which adversely affect the quality of plating, and is therefore considered suited for bump plating in which plating is performed for relatively large-sized holes and which requires a considerably long plating time.

A common conventional electroplating apparatus using a dip method, which has the advantage of good release of bubbles, is provided with a substrate holder which detachably holds a substrate, such as a semiconductor wafer, with its front surface (surface to be plated) exposed while sealing an end surface and a back surface of the substrate. The substrate holder, together with a substrate, is immersed in a plating solution in carrying out plating of the surface of the substrate.

Because the substrate holder is kept immersed in the plating solution during plating, a peripheral portion and a back surface of a substrate, held by the substrate holder, must be securely sealed so that the plating solution will not intrude into the back surface side of the substrate. Therefore, the applicant has proposed a substrate holder configured to detachably hold a substrate, in which a substrate is held between a fixed holding member and a movable holding member while an inner seal member, attached to the movable holding member, is kept in pressure contact with a peripheral portion of the substrate and an outer seal member, attached to the movable holding member, is kept in pressure contact with the fixed holding member to seal the contact portions (see Japanese Patent Laid-Open Publications No. 2004-52059 and No. 2004-76022).

In such a substrate holder, it is necessary to securely seal the connection between a seal member and a member for fixing the seal member (e.g., a seal holder or a fixing ring) in order to securely prevent leakage of liquid through the connection.

The conventional substrate holder therefore has the following exemplary construction: As shown in FIG. 1, a movable holding member 100 includes a ring-shaped seal holder 102 and two fixing rings 108, 110 for respectively fixing an inner seal member 104 and an outer seal member 106 to the seal holder 102. The inner seal member 104 is interposed between an upper surface of the seal holder 102 and the upper fixing ring 108, and the upper fixing ring 108 is secured to the seal holder 102 by tightening bolts 112, thereby bringing the inner seal member 104 into uniform and tight contact with the seal holder 102 and the upper fixing ring 108. Further, the outer seal member 106 is interposed between a lower surface of the seal holder 102 and the lower fixing ring 110, and the lower fixing ring 110 is secured to the seal holder 102 by tightening bolts 114, thereby bringing the outer seal member 106 into uniform and tight contact with the seal holder 102 and the lower fixing ring 110. When the substrate holder holds a substrate W by gripping a peripheral portion of the substrate W between the movable holding member 100 and a fixed holding member 116 while thus sealing the connection between the seal holder 102 and the inner seal member 104 and the connection between the seal holder 102 and the outer seal member 106, an inner peripheral end of the inner seal member 104 makes pressure contact with and seals a peripheral portion of the substrate W, and an outer peripheral end of the outer seal member 106 makes pressure contact with and seals an upper surface of the fixed holding member 116.

The substrate holder shown in FIG. 1, however, has been found to have problems in maintenance, especially in replacement of the seal members 104, 106. In particular, the replacement necessitates the operation of removing the used seal members 104, 106 from the movable holding member 100 by removing a total of, for example, 98 bolts 112, 114, putting new seal members 104, 106 between the seal holder 102 and the upper fixing ring 108 and between the seal holder 102 and the lower fixing ring 110, respectively, and thereafter fixing the new seal members 104, 106 to the movable holding member 100 by tightening the 98 bolts 112, 114.

SUMMARY OF THE INVENTION

The present invention has been made in view of the above situation. It is therefore an object of the present invention to provide a substrate holder which enables easy maintenance, especially easy replacement of seal members, and to provide a plating apparatus provided with the substrate holder.

In order to achieve the above object, the present invention provides a substrate holder comprising: a fixed holding member and a movable holding member for detachably holding a substrate by gripping a peripheral portion of the substrate therebetween; and an inner seal member and an outer seal member which are fixed to the movable holding member and which, when the substrate is held by the movable holding member and the fixed holding member, seal the connection between the movable holding member and the peripheral portion of the substrate and the connection between the movable holding member and the fixed holding member, respectively. The movable holding member includes a seal holder, and the inner seal member and the outer seal member are fixed between the seal holder and a fixing ring secured to the seal holder.

The inner seal member and the outer seal member are thus fixed to the seal holder by a single (only one) fixing ring. This can reduce the number of fastening tools, such as bolts, necessary for the fixing of the inner seal member and the outer seal member to the seal holder, thereby significantly facilitating maintenance of the substrate holder, especially replacement of the seal members.

The seal holder preferably has a groove for fitting therein at least one of an outer peripheral portion of the inner seal member and an inner peripheral portion of the outer seal member.

By thus fitting at least one of an outer peripheral portion of the inner seal member and an inner peripheral portion of the outer seal member into the groove provided in the seal holder, the connection between the seal holder and the at least one of the inner seal member and the outer seal member can be sealed with that portion of the seal member which lies in the groove. Further, the fixing ring can prevent escape of the at least one of the inner seal member and the outer seal member from the seal holder.

At least one of the inner seal member and the outer seal member may have a sealing protrusion on a surface to be in contact with the seal holder.

When fixing the inner seal member and the outer seal member to the movable holding member by fixing the seal members between the seal holder and the fixing ring, the sealing protrusion, provided in the contact surface with the seal holder of the at least one of the inner seal member and the outer seal member, is deformed elastically. This can seal the connection between the seal holder and the at least one of the inner seal member and the outer seal member.

At least one of the inner seal member and the outer seal member may have a pressure contact portion which is deformed elastically by a tightening force produced upon fixing of the fixing ring to the seal holder and makes pressure contact with the seal holder.

Thus, the connection between the seal holder and the at least one of the inner seal member and the outer seal member can be sealed by the pressure contact portion.

The inner seal member and the outer seal member may be formed integrally.

By integrally forming the inner seal member and the outer seal member, there is no need to provide a sealing mechanism between the seal members and the seal holder. This can reduce the number of parts and simplify the structure.

The present invention also provides a plating apparatus comprising the above-described substrate holder, and a plating tank for holding a plating solution therein.

According to the substrate holder of the present invention, the inner seal member and the outer seal member are fixed to the seal holder by a single fixing ring. This can reduce the number of fastening tools, such as bolts, necessary for the fixing of the inner seal member and the outer seal member to the seal holder, thereby significantly facilitating maintenance of the substrate holder, especially replacement of the seal members.

DETAILED DESCRIPTION OF THE PREFERRED EMBODIMENTS

Figure 1:
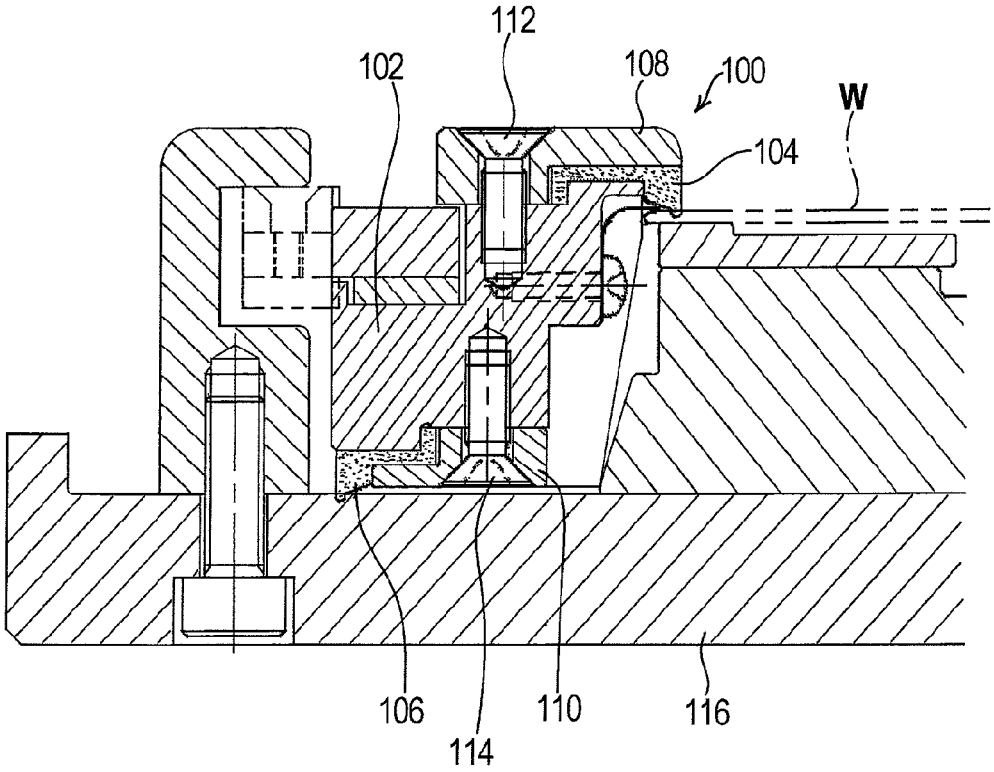
FIG. 1 is an enlarged cross-sectional view of the main portion of a conventional substrate holder.

Preferred embodiments of the present invention will now be described with reference to FIGS. 2 through 16. In the following description, the same reference numerals are used for the same or equivalent members, and a duplicate description thereof will be omitted.

Figure 2:
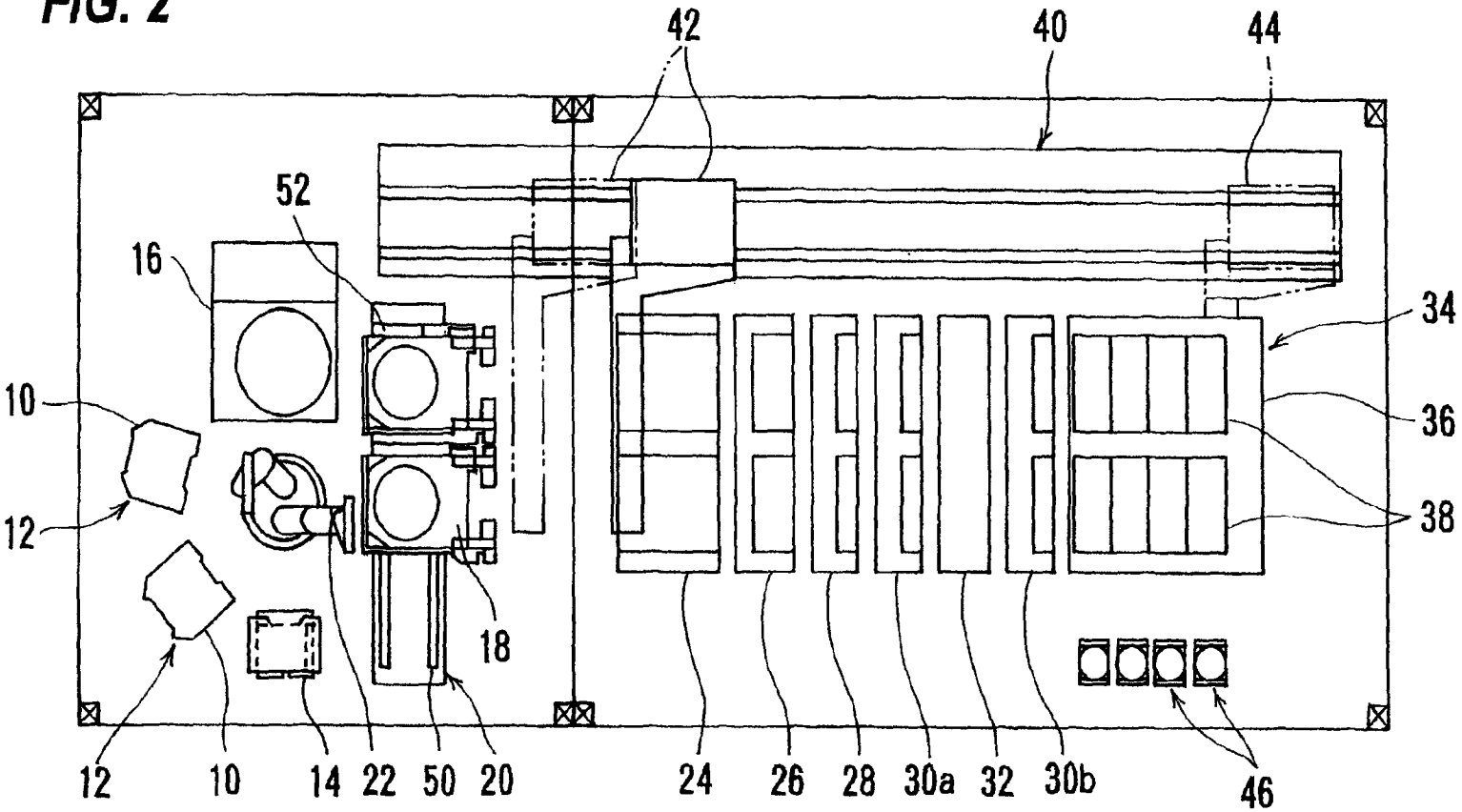
FIG. 2 is an overall layout plan view of a plating apparatus provided with a substrate holder according to an embodiment of the present invention.

FIG. 2 shows the overall layout plan of a plating apparatus provided with a substrate holder according to an embodiment of the present invention. As shown in FIG. 2, the plating apparatus includes two cassette tables 12 each mounted with a cassette 10 in which substrates W, such as semiconductor wafers, are housed, an aligner 14 for aligning an orientation flat or a notch of a substrate W in a predetermined direction, and a spin drier 16 for drying a substrate W after plating by rotating it at a high speed. Near these units is provided a substrate attachment/detachment section 20 for placing a substrate holder 18 thereon and attaching and detaching a substrate W to and from the substrate holder 18. Further, in the center of these units is disposed a substrate transport device 22 comprised of a transport robot for transporting a substrate W between the units.

The plating apparatus also includes a stocker 24 for temporarily storing substrate holders 18, a pre-wetting tank 26 for immersing a substrate W in pure water, a pre-soaking tank 28 for etching away an oxide film, e.g., on a surface of a seed layer formed on a surface of the substrate W, a first water-cleaning tank 30*a* for cleaning the surface of the wafer W with pure water, a blow tank 32 for draining the substrate W after cleaning, a second water-cleaning tank 30*b*, and a plating tank 34, which are arranged in this order from the side of the substrate attachment/detachment section 20. The plating tank 34 is comprised of an overflow tank 36 and a plurality of copper plating units 38 housed in the overflow tank 36. Each copper plating unit 38 is configured to house one substrate W therein and perform copper plating of the substrate W. Though copper plating is performed in this embodiment, it is also possible to perform plating with nickel, solder, silver or gold.

Located lateral to the above devices, there is provided a substrate holder transport device 40, driven, e.g., by a linear motor, for transporting a substrate holder 18, together with a substrate W, between the devices. The substrate holder transport device 40 has a first transporter 42 for transporting a substrate W between the substrate attachment/detachment section 20 and the stocker 24, and a second transporter 44 for transporting the substrate W between the stocker 24, the pre-wetting tank 26, the pre-soaking tank 28, the water-cleaning tanks 30*a*, 30*b*, the blow tank 32 and the plating tank 34. The substrate holder transport device 40 may be provided with only the first transporter 42 without the second transporter 44 being provided.

On the opposite side of the overflow tank 36 from the substrate holder transport devise 40 is disposed a paddle drive device 46 for driving a paddle (not shown) provided in each copper plating unit 38 as a stirring rod for stirring a plating solution.

The substrate attachment/detachment section 20 includes a flat pedestal plate 52 which is laterally slidable along rails 50. Two substrate holders 18, parallel to each other, are placed in a horizontal position on the pedestal plate 52. After transferring a substrate W between one substrate holder 18 and the substrate transport device 22, the pedestal plate 52 is slid laterally and a substrate W is transferred between the other substrate holder 18 and the substrate transport device 22.

As shown in FIGS. 3 through 10, the substrate holder 18 includes a rectangular and tabular fixed holding member 54, e.g., made of polyvinyl chloride, and a movable holding member 58 openably and closably mounted to the fixed holding member 54 via a hinge 56. In this embodiment, the movable holding member 58 is configured to be openable and closable by the hinge 56. It is also possible, for example, to dispose the movable holding member 58 opposite the fixed holding member 54, and to open or close the movable holding member 58 by moving it away from or toward the fixed holding member 54.

The movable holding member 58 includes a base portion 60 and a ring-shaped seal holder 62, and is made of, for example, polyvinyl chloride so that it is slidable with respect to the below-described retainer ring 64. An inwardly-projecting inner seal member 66, which makes pressure contact with a peripheral portion of the substrate W and seals the contact portion when a substrate W is held by the substrate holder 18, is fixed on a surface, facing the fixed holding member 54, of the seal holder 62. An outer seal member 68, which makes pressure contact with the fixed holding member 54 and seals the contact portion at a position outside the inner seal member 66, is fixed on a surface, facing the fixed holding member 54, of the seal holder 62.

Figure 7:
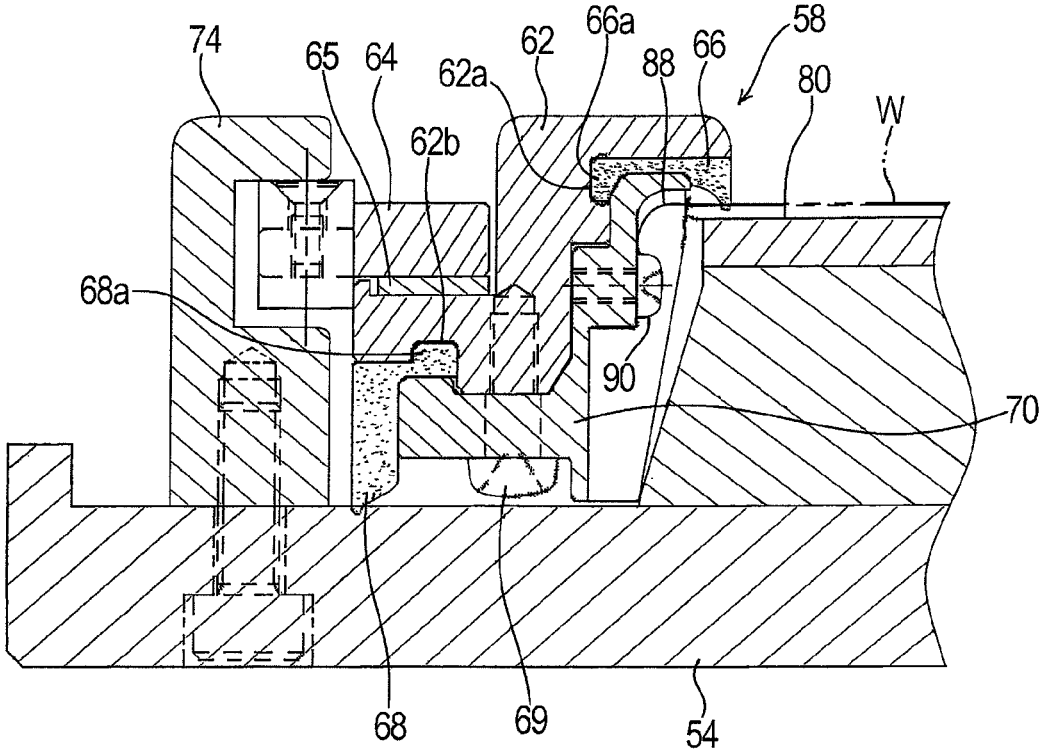
FIG. 7 is an enlarged cross-sectional view of the main portion of the substrate holder shown in FIG. 2.

As shown in FIG. 7, the inner seal member 66 and the outer seal member 68 are fixed between the seal holder 62 and a single (only one) fixing ring 70 which is secured to the seal holder 62 via fastening tools 69 such as bolts. In particular, the seal holder 62 has an outwardly-recessed inner groove 62*a* for fitting in it the outer downwardly-projecting portion 66*a* of the inner seal member 66, and an upwardly-recessed outer groove 62*b* for fitting in it the inner upwardly-projecting portion 68*a* of the outer seal member 68. The inner seal member 66 and the outer seal member 68 are temporarily fixed to the seal holder 62 by fitting (pressing) the outer downwardly-projecting portion 66*a* of the inner seal member 66 into the inner groove 62*a* of the seal holder 62 and fitting (pressing) the inner upwardly-projecting portion 68*a* of the outer seal member 68 into the outer groove 62*b* of the seal holder 62.

Thereafter, the fixing ring 70, having such a shape as to be capable of holding the major portion of the inner seal member 66 and the major portion of the outer seal member 68 between it and the seal holder 62, is secured to the seal holder 62 by tightening the fastening tools (bolts) 69, thereby fixing the inner seal member 66 and the outer seal member 68 to the seal holder 62.

The inner seal member 66 and the outer seal member 68 are thus fixed to the seal holder 62 by the single fixing ring 70. This can reduce the number of the fastening tools 69, such as bolts, necessary for the fixing of the inner seal member 66 and the outer seal member 68 to the seal holder 62, thereby significantly facilitating maintenance of the substrate holder 18, especially replacement of the seal members 66, 68 or the like.

Furthermore, by fitting (pressing) the outer projecting portion 66*a* of the inner seal member 66 and the inner projecting portion 68*a* of the outer seal member 68 into the inner groove 62*a* and the outer groove 62*b* of the seal holder 62, respectively, the connection between the inner seal member 66 and the seal holder 62 can be sealed with the projecting portion 66*a* that fills the inner groove 62*a*, and the connection between the outer seal member 68 and the seal holder 62 can be sealed with the projecting portion 68*a* that fills the outer groove 62*b*. Moreover, the fixing ring 70 can prevent escape of the inner seal member 66 and the outer seal member 68 from the seal holder 62. In this case, a small number of the fastening tools 69 will be sufficient if it can prevent escape of the inner seal member 66 and the outer seal member 68 from the seal holder 62.

A peripheral stepped portion is formed in the seal holder 62 of the movable holding member 58, and a retainer ring 64 is rotatably mounted to the stepped portion via a seal ring spacer 65. The retainer ring 64 is inescapably held by outwardly projecting retainer plates 72 (see FIG. 4) mounted to the side surface of the seal holder 62. The retainer ring 64 is composed of a material having high rigidity and excellent acid corrosion resistance, for example titanium, and the seal ring spacer 65 is composed of a material having a low friction coefficient, for example PTEF, so that the retainer ring 64 can rotate smoothly.

Positioned outside of the retainer ring 64, inverted L-shaped clampers 74, having an inwardly projecting portion, are disposed on the fixed holding member 54 at regular intervals along the circumferential direction. The surface of the retainer ring 64 and the lower surface of the inwardly projecting portion of each clamper 74, which is disposed such that it covers the surface of the retainer ring 64, are tapered in opposite directions along the rotating direction of the retainer ring 64. A plurality of, for example four, upwardly protruding raised dots 64*a* are provided on the retainer ring 64 in predetermined positions along the circumferential direction. Thus, the retainer ring 64 can be rotated by pushing and moving each raised dot 64*a* from the side by a rotating pin (not shown).

When the movable holding member 58 is open, a substrate W is inserted into the central portion of the fixed holding member 54, and then the movable holding member 58 is closed by the hinge 56. When the retainer ring 64 is rotated clockwise, the peripheral portion of the retainer ring 64 slides into the inwardly projecting portion of each clamper 74, and the fixed holding member 54 and the movable holding member 58 come to be fastened to each other and locked by engagement between the tapered surfaces of the retainer ring 64 and each clamper 74. The lock is released by rotating the retainer ring 64 counterclockwise and withdrawing the peripheral portion of the retainer ring 64 from the projecting portion of each clamper 74. When the movable holding member 58 is thus locked, the lower end of the inner downwardly-protruding portion of the inner seal member 66 makes pressure contact with the peripheral portion of the substrate W held by the substrate holder 18, while the lower end of the outer downwardly-protruding portion of the outer seal member 68 makes pressure contact with the surface of the fixed holding member 54, whereby the seal members 66, 68 are uniformly pressed and the contact portions are sealed.

In the peripheral area of the fixed holding member 54 is provided a protruding portion 82 which protrudes in a ring according to the size of the substrate W and has an upper support surface 80 which makes contact with the peripheral portion of the substrate W and supports the substrate W. The protruding portion 82 has recesses 84 at predetermined positions along the circumferential direction.

Figure 6:
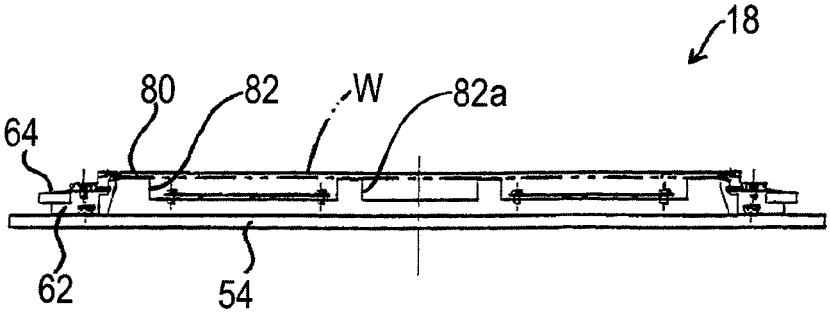
FIG. 6 is a vertical sectional front view of the substrate holder shown in FIG. 2.

In this embodiment, as shown in FIG. 6, the ring-shaped protruding portion 82 is provided in the fixed holding member 54 at a position along the peripheral portion of the substrate W and, in addition, a ring-shaped protruding portion 82*a* is further provided in the fixed holding member 54 at a position corresponding to a central portion of the substrate W. With this structure, the substrate W can be easily held in a horizontal position by supporting the central portion of the substrate W on the upper surface of the protruding portion 82*a*. A substrate is sometimes warped, or sometimes warps due to plating. When a warped substrate is held by the substrate holder 18 having the fixed holding member 54 provided with the central protruding portion 82*a*, upward warping of the peripheral portion of the substrate can be misdetected as a positional abnormality in the substrate. Such a warped substrate can be dealt with by lowering the height of the central protruding portion 82*a*, or omitting the central protruding portion 82*a*.

Figure 4:
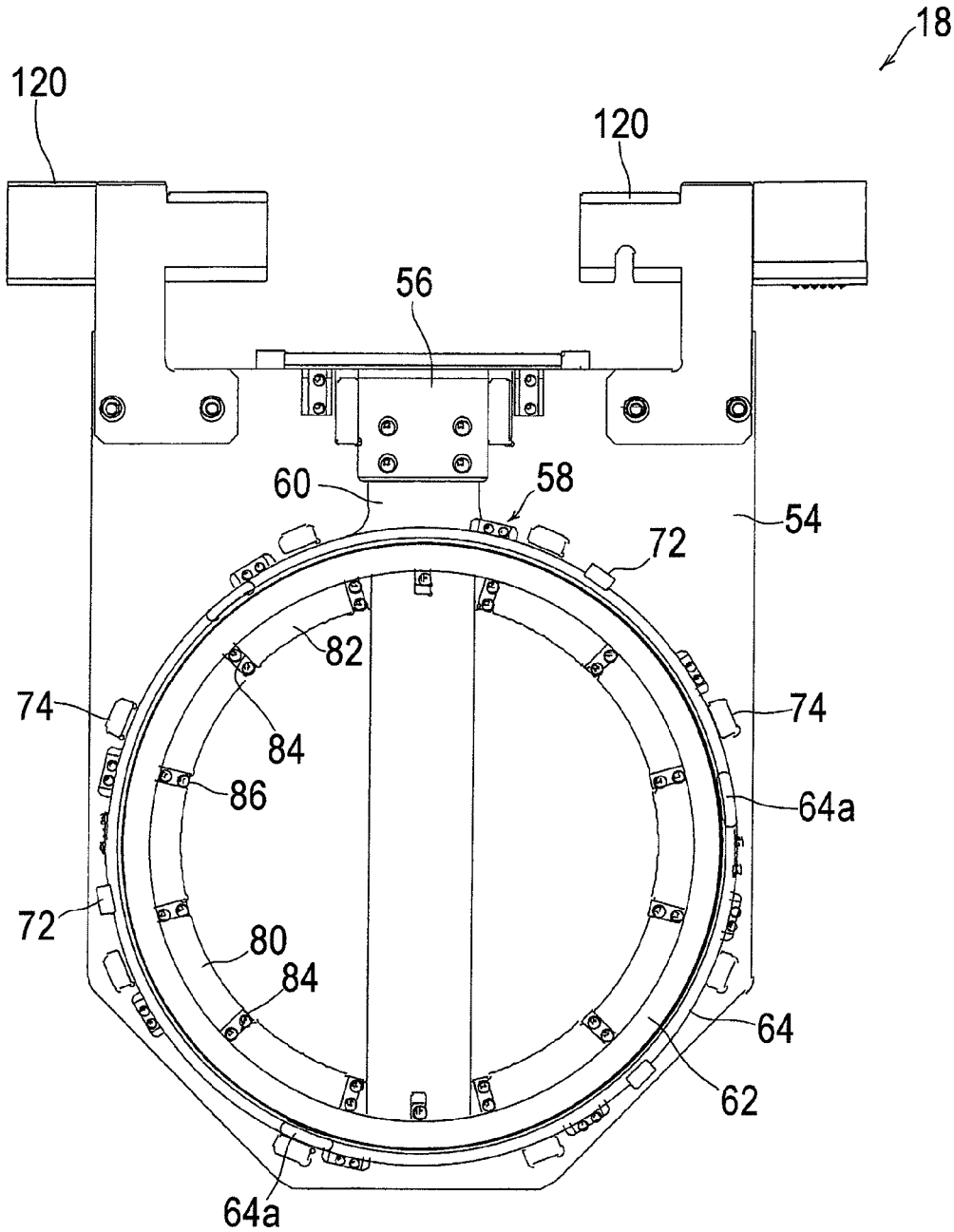
FIG. 4 is a plan view of the substrate holder shown in FIG. 2.

As shown in FIG. 4, a plurality of electrical conductors (electrical contacts) 86 (12 contacts are illustrated), connected to conducting wires extending from external contacts provided in hands 120, are disposed in the recesses 84 of the protruding portion 82. When the substrate W is placed on the support surface 80 of the fixed holding member 54, the ends of the electrical conductors 86 are exposed on the surface of the fixed holding member 54 in a springy state at positions beside the substrate W and make contact with lower portions of the electrical contacts 88 shown in FIG. 7.

The electrical contacts 88, to be electrically connected to the conductors 86, are secured to the fixing ring 70 of the movable holding member 58 by bolts 90. The electrical contacts 88 each have a leaf spring-like contact portion lying outside the inner seal member 66 and projecting inwardly. The contact portion is springy by its elasticity and bends easily. When the substrate W is held by the fixed holding member 54 and the movable holding member 58, the contact portions of the electrical contacts 88 make elastic contact with the peripheral surface of the substrate W supported on the support surface 80 of the fixed holding member 54.

Figure 3:
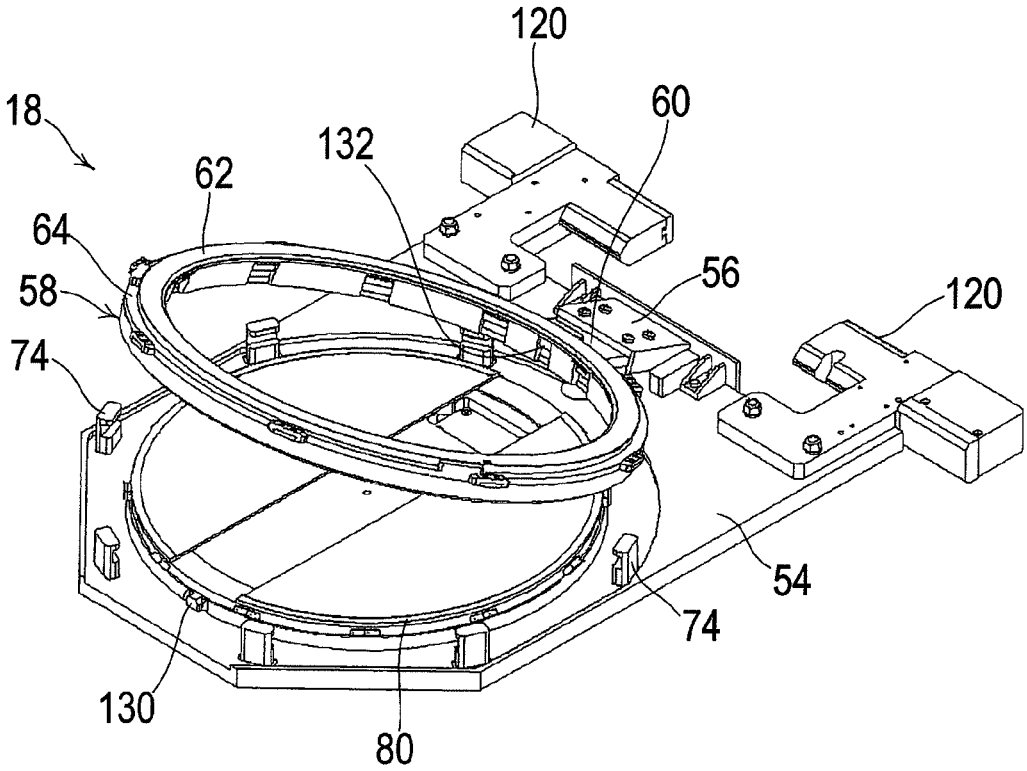
FIG. 3 is a schematic perspective view of the substrate holder shown in FIG. 2.
Figure 5:
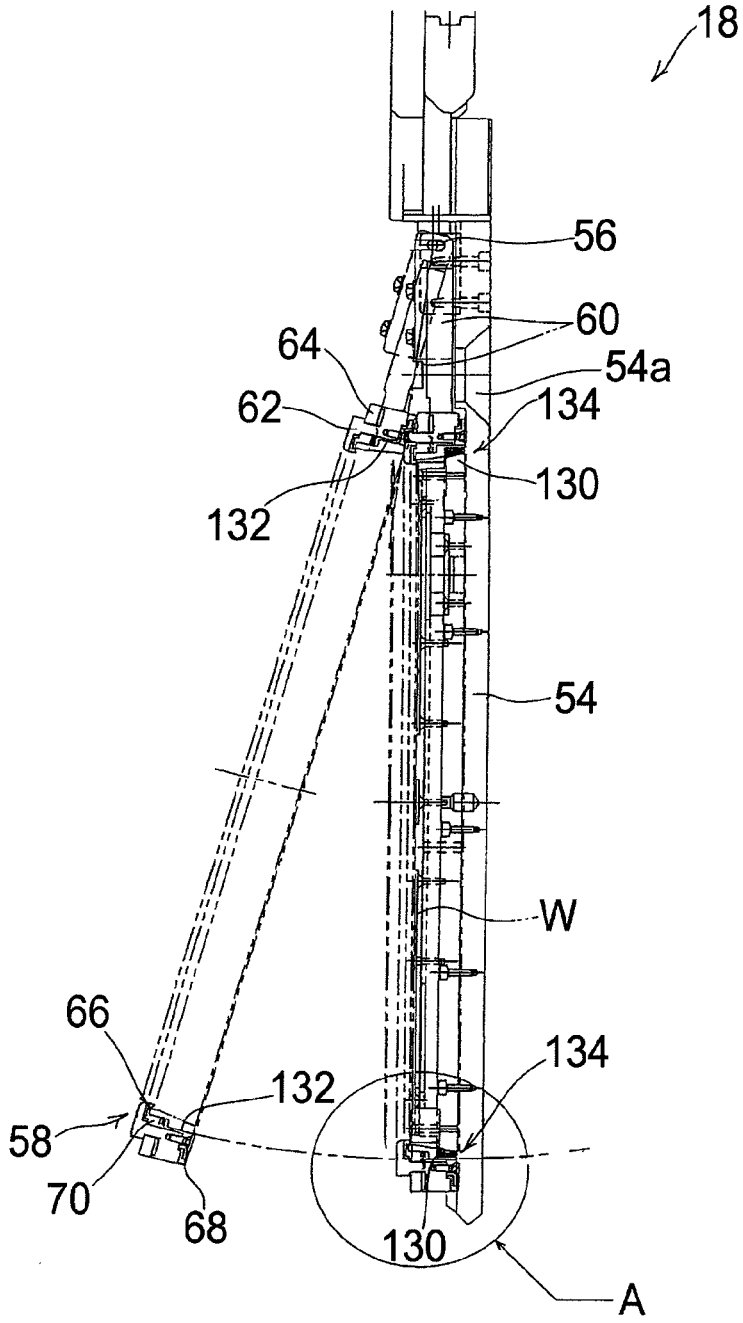
FIG. 5 is a right side view of the substrate holder shown in FIG. 2.

As shown in FIGS. 3 and 5, two alignment mechanisms 134, each consisting of an alignment block 130 and an alignment groove 132, are provided between the fixed holding member 54 and the movable holding member 58 at positions corresponding to the periphery of the substrate W held by the substrate holder 18. One of the two alignment mechanisms 134 is positioned near the hinge 56 (hereinafter referred to as "upper alignment mechanism 134") and the other is positioned far from the hinge 56 (hereinafter referred to as "lower alignment mechanism 134"). In FIG. 3, only the alignment block 130 of the lower alignment mechanism 134 and the alignment groove 132 of the upper alignment mechanism 134 are shown.

Figure 8:
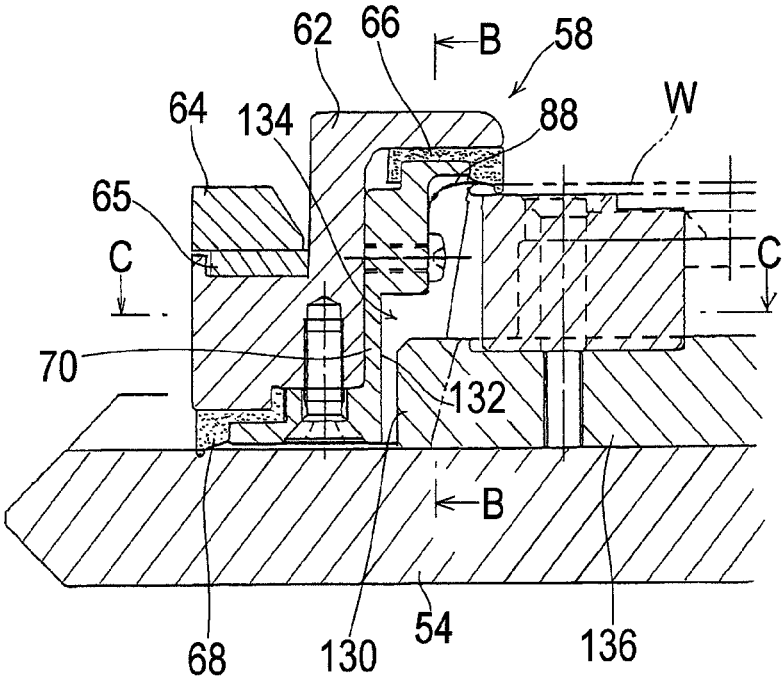
FIG. 8 is an enlarged view of the portion A of FIG. 5.
Figure 9:
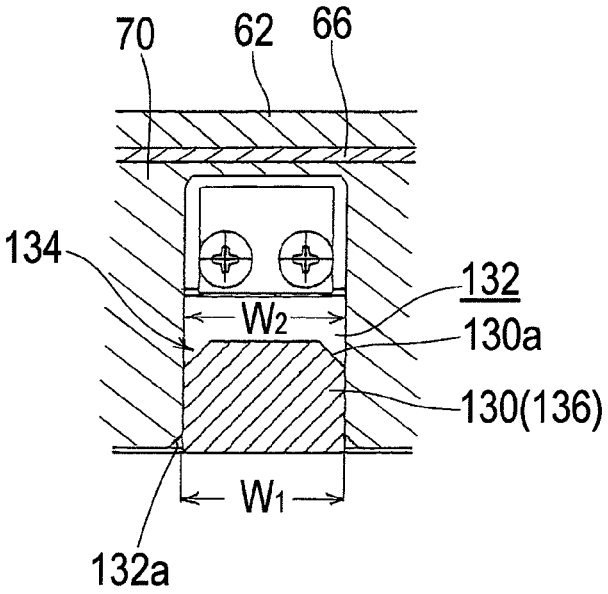
FIG. 9 is a cross-sectional view taken along line B-B of FIG. 8.
Figure 10:
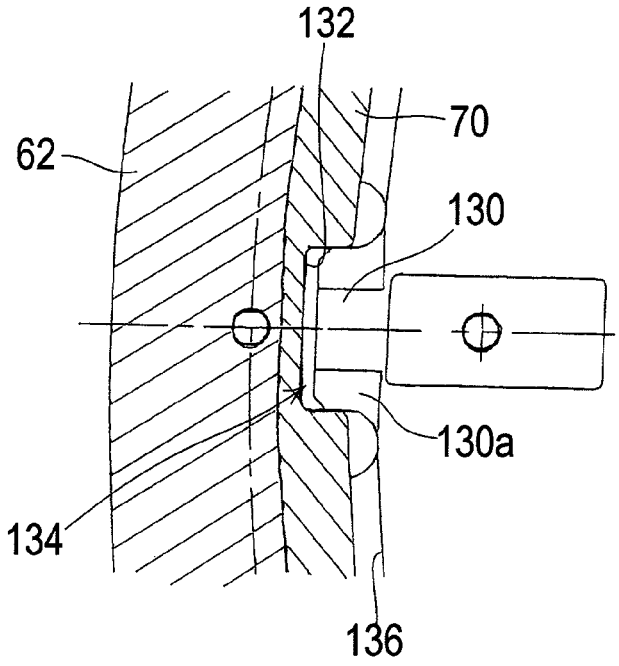
FIG. 10 is a cross-sectional view taken along line C-C of FIG. 8.

As shown in FIGS. 8 through 10, each alignment block 130 is comprised of a rectangular outwardly-projecting portion of a base plate 136 mounted on the upper surface of the fixed holding member 54, while each alignment groove 132 is a rectangular groove formed in the inner peripheral surface of the fixing ring 70 secured to the seal holder 62 of the movable holding member 58. In each alignment mechanism 134, when the movable holding member 58 is closed, the alignment block 130 provided in the base plate 136 engages the alignment groove 132 provided in the inner peripheral surface of the fixing ring 70. In this case, the tolerance range for the difference determined by the fit tolerance between the width $W_1$ of the alignment block 130 and the width $W_2$ of the alignment groove 132 may be, for example, within the range of ±0.06 mm.

Tapered surfaces 130*a* are provided on both sides of the upper surface of each alignment block 130, and chamfered portions 132*a* are formed in the side surfaces of each alignment groove 132 on the side of the fixed holding member 54. This enables the alignment block 130 to smoothly engage the alignment groove 132 when the movable holding member 58 is closed.

By thus providing the alignment mechanism 134 between the fixed holding member 54 and the fixed holding member 54 in which the alignment block 130 provided in the fixed holding member 54 and the alignment groove 132 provided in the movable holding member 58 engage each other, it becomes possible to perform centering of the fixed holding member 54 on which a substrate W is placed and the movable holding member 58 having the seal members 66, 68 and the electrical contacts 88. Thus, precise positioning of the sealing positions of the seal members 66, 68 and the contact positions of the electrical contacts 88 on the substrate W becomes possible. This can minimize edge exclusion.

Without the alignment mechanism 134, misalignment could be produced between the fixed holding member 54 and the movable holding member 58 when locking the movable holding member 58 to the fixed holding member 54. The misalignment will produce misalignment between a substrate W on the fixed holding member 54 and the seal members 66, 68 and the electrical contacts 88 fixed to the movable holding member 58. This problem can be avoided by preforming centering of the fixed holding member 54 and the movable holding member 58 by the alignment mechanism 134 according to this embodiment.

In this embodiment, two alignment mechanisms 134 are provided. However, the number of the alignment mechanisms is not particularly limited. Four alignment mechanisms 134, upper, lower, right and left ones, are preferably provided especially in a discrete-type substrate holder having a fixed holding member and a movable holding member which are separated from each other.

Though not shown diagrammatically, the substrate holder 18 is provided with centering springs having a centering (positioning) function for a substrate W, and a sticking prevention mechanism which, when a substrate W after plating is taken out of the substrate holder 18, prevents the substrate W from sticking to the inner seal member 66 and lifting together. The electrical contacts 88 may have such substrate centering function and sticking prevention function.

The movable holding member 58 is opened/closed by a not-shown cylinder and by the weight of the movable holding member 58 itself. In particular, a through-hole 54*a* is provided in the fixed holding member 54, and a cylinder is provided at a position where the cylinder faces the through-hole 54 when the substrate holder 18 is placed on the pedestal plate 52. With this structure, the movable holding member 58 is opened by extending a cylinder rod to lift up a pressing rod through the through-hole 54*a* and thereby push up the seal holder 62 of the movable holding member 58. The movable holding member 58 is closed by its own weight by retracting the cylinder rod.

To the end of the fixed holding member 54 of the substrate holder 18 is coupled a pair of generally T-shaped hands 120 which serve as a support during transport of the substrate holder 18 or when the substrate holder 18 is held in a suspended state. In the stocker 24, the outwardly projecting portions of the hands 120 are placed on the upper surface of the peripheral wall of the stocker 24, whereby the substrate holder 18 is suspended in a vertical position. When transporting the substrate holder 18 from the stocker 24, the hands 120 of the suspended substrate holder 18 are gripped by the transporter 42 of the substrate holder transport device 40. Also in the pre-wetting tank 26, the pre-soaking tank 28, the water-cleaning tanks 30*a*, 30*b*, the blow tank 32 and the plating tank 34, the substrate holder 18 is held in a suspended state with the hands 120 placed on the peripheral wall of the tank.

A sequence of plating process steps carried out by the thus-constructed plating apparatus will now be described. First, one substrate is taken by the substrate transport device 22 out of the cassette 10 mounted on the cassette table 12, and the substrate is placed on the aligner 14 to align an orientation flat of a notch in a predetermined direction. After the alignment, the substrate is transported to the substrate attachment/detachment section 20 by the substrate transport device 22.

On the other hand, two substrate holders 18 housed in the stocker 24 are simultaneously gripped by the transporter 42 of the substrate holder transport device 40, and transported to the substrate attachment/detachment section 20. The substrate holders 18 are lowered in a horizontal position to simultaneously place the two substrate holders 18 on the pedestal plate 52 of the substrate attachment/detachment section 20, and then the cylinder is actuated to open the movable holding member 58 of each substrate holder 18.

In this state, the substrate, which has been transported by the substrate transport device 22, is inserted into the substrate holder 18 positioned on the center side, and the cylinder is reversely actuated to close the movable holding member 58, and then the movable holding member 58 is locked by the locking/unlocking mechanism. As described above, upon the locking of the movable holding member 58, the alignment block 130 provided in the fixed holding member 54 engages the alignment groove 132 provided in the movable holding member 58. This prevents misalignment between the fixed holding member 54 and the movable holding member 58. After completion of the attachment of the substrate to the one substrate holder 18, the pedestal plate 52 is slid laterally, and a substrate is attached to the other substrate holder 18 in the same manner. Thereafter, the pedestal plate 52 is returned to the original position.

By the above operation, a substrate W is fixed in the substrate holder 18 with its front surface (to be plated) exposed in the opening of the substrate holder 18 and its periphery and back surface sealed with the seal members 66, 68 to prevent intrusion of a plating solution and to allow electrical connection of a sealed portion, not in contact with the plating solution, with the electrical contacts 88. Conducting wires from the electrical contacts 88 are connected to the hands 120 of the substrate holder 18. Therefore, electricity can be fed to a seed layer or the like of the substrate by connecting a power source to the hands 120. The substrate attachment/detachment section 20 has a sensor for sensing the electrical contact between a substrate W, attached to the substrate holder 18, and the electrical contacts 88. The sensor, when it determines poor contact between a substrate W and the electrical contacts 88, outputs the signal to a controller (not shown).

Next, the two substrate holders 18 loaded with the substrates W are simultaneously gripped by the transporter 42 of the substrate holder transport device 40 and transported to the stocker 24. The two substrate holders 18 are lowered in a vertical position to suspend them in the stocker 24 for temporary storage. The substrate transport device 22, the substrate attachment/detachment section 20 and the transporter 42 of the substrate holder transport device 40 sequentially repeat the above operations to sequentially attach substrates to substrate holders 18 which have been housed in the stocker 24 and sequentially suspend the substrate holders 18 at predetermined positions in the stocker 24 for their temporary storage.

Though not shown diagrammatically, instead of the substrate attachment/detachment section 20 on which two substrate holders 18 are placed in a horizontal position, it is possible to provide a fixing station which supports two substrate holders, which have been transported by the transporter 42, in a vertical position. The substrate holders can be brought into a horizontal position by rotating the fixing station, holding the substrate holders in a vertical position, by 90 degrees.

Though in this embodiment the one locking/unlocking mechanism is provided, it is possible to provide two locking/unlocking mechanisms and to simultaneously perform locking/unlocking of two substrate holders disposed adjacent to each other by the two locking/unlocking mechanisms.

Two substrate holders 18 loaded with substrates, which have been temporarily stored in the stocker 24, are simultaneously gripped by the other transporter 44 of the substrate holder transport device 40 and transported to the pre-wetting tank 26, where the two substrate holders 18 are lowered to place them into the pre-wetting tank 26.

A substrate holder 18 in which is housed a substrate whose contact with the electrical contacts 88 has been determined to be poor by the sensor, provided in the substrate attachment/detachment section 20, for sensing contact between a substrate and the electrical contacts, is kept temporarily stored in the stocker 24. This enables continuing plating operations without a stop of the apparatus despite the poor contact between the electrical contacts 88 and the substrate held in the substrate holder 18. The substrate of poor electrical contact is not subjected to plating. Instead, the unplated substrate is returned to the cassette and then removed from the cassette.

Next, in the same manner as described above, the two substrate holders 18 loaded with the substrates are transported to the pre-soaking tank 28. In the pre-soaking tank 28, a surface oxide film of each substrate is etched away, thereby exposing a clean metal surface. Thereafter, in the same manner as described above, the substrate holders 18 loaded with the substrates are transported to the water-cleaning tanks 30*a*, and the surface of each substrate is cleaned with pure water held in the water-cleaning tank 30*a*.

In the same manner as described above, the two substrate holders 18 loaded with the substrates after cleaning are transported to the plating tank 34 filled with a plating solution, and are each suspended and held at a predetermined position in the plating unit 38. The transporter 44 of the substrate holder transport device 40 sequentially repeats the above operations to sequentially transport substrate holders 18, each loaded with a substrate, to the plating units 38 of the plating tank 34, and suspend the substrate holders 18 at predetermined positions in the plating units 38.

After suspending substrate holders 18 in all the plating units 38, plating of each substrate is carried out in the following manner: While circulating a plating solution in the overflow tank 36 and allowing the plating solution to overflow into the overflow tank 36, a plating voltage is applied between each substrate W and an anode (not shown) in the plating tank 34 and, at the same time, a paddle is reciprocated parallel to the surface of the substrate by the paddle drive device 46. During the plating, each substrate holder 18 is suspended and fixed with the hands 120 supported on the top of each plating unit 38, and electricity is fed from a plating power source to a seed layer or the like through the electrical conductors 86 and the electrical contacts 88.

After the completion of plating, the application of the plating voltage, the supply of the plating solution and the reciprocation of the paddle are stopped. Thereafter, in the same manner as described above, two substrate holders 18 loaded with substrates after plating are simultaneously gripped by the transporter 44 of the substrate holder transport device 40, and are transported to the water-cleaning tank 30*b*. The surface of each substrate is cleaned by immersing the substrate in pure water held in the water-cleaning tanks 30*b*. Thereafter, in the same manner as described above, the substrate holders 18 loaded with the substrates are transported to the blow tank 32, where water droplets are removed from the substrate holders 18 by air blowing. Thereafter, in the same manner as described above, the substrate holders 18 loaded with the substrates are returned to the stocker 24 and are each suspended and held at a predetermined position in the stocker 24.

The transporter 44 of the substrate holder transport device 40 sequentially repeats the above operations to sequentially return substrate holders 18, each loaded with a substrate after plating, to predetermined positions in the stocker 24 and suspend the substrate holders 18 in the stocker 24.

Two substrate holders 18 loaded with substrates, which have been temporarily stored in the stocker 24, are simultaneously gripped by the other transporter 42 of the substrate holder transport device 40, and are placed on the pedestal plate 52 of the substrate attachment/detachment section 20 in the same manner as described above. The substrate holder 18 in which is housed a substrate whose contact with the electrical contacts 88 has been determined to be poor by the sensor, provided in the substrate attachment/detachment section 20, for sensing contact between a substrate and the electrical contacts and which has been kept temporarily stored in the stocker 24, is also transported and placed on the pedestal plate 52.

The movable holding member 58 of the substrate holder 18 positioned on the center side is unlocked by the locking/unlocking mechanism, and the cylinder is actuated to open the movable holding member 58. As described above, the substrate W is prevented from sticking to the movable holding member 58 as it opens. The substrate W after plating is then taken by the substrate transport device 22 out of the substrate holder 18, and transported to the spin drier 16, where the substrate is spin-dried (drained) by high-speed rotation of the spin drier 16. The dried substrate is returned by the substrate transport device 22 to the cassette 10.

After or in parallel with returning the substrate, which has been taken out of the one substrate holder 18, to the cassette 10, the pedestal plate 52 is slid laterally and the other substrate is taken out of the other substrate holder 18. The substrate is then spin-dried by the spin drier 16, and the dried substrate is returned to the cassette 10.

After returning the pedestal plate 52 to the original position, the two substrate holders 18, from which the substrates have been taken out, are simultaneously gripped by the transporter 42 of the substrate holder transport device 40 and, in the same manner as described above, are returned to predetermined positions in the stocker 24. Thereafter, two substrate holders 18, from which the substrates have been taken out after plating and returned to the stocker 24, are simultaneously gripped by the substrate holder transport device 40 and, in the same manner as described above, are placed on the pedestal plate 52 of the substrate attachment/detachment section 20. Thereafter, the same operations as described above are repeated.

The sequence of operations are completed when all the substrates after plating, taken out of the substrate holders 18 which have been returned to the stocker 24, are spin-dried and returned to the cassette 10.

Figure 11:
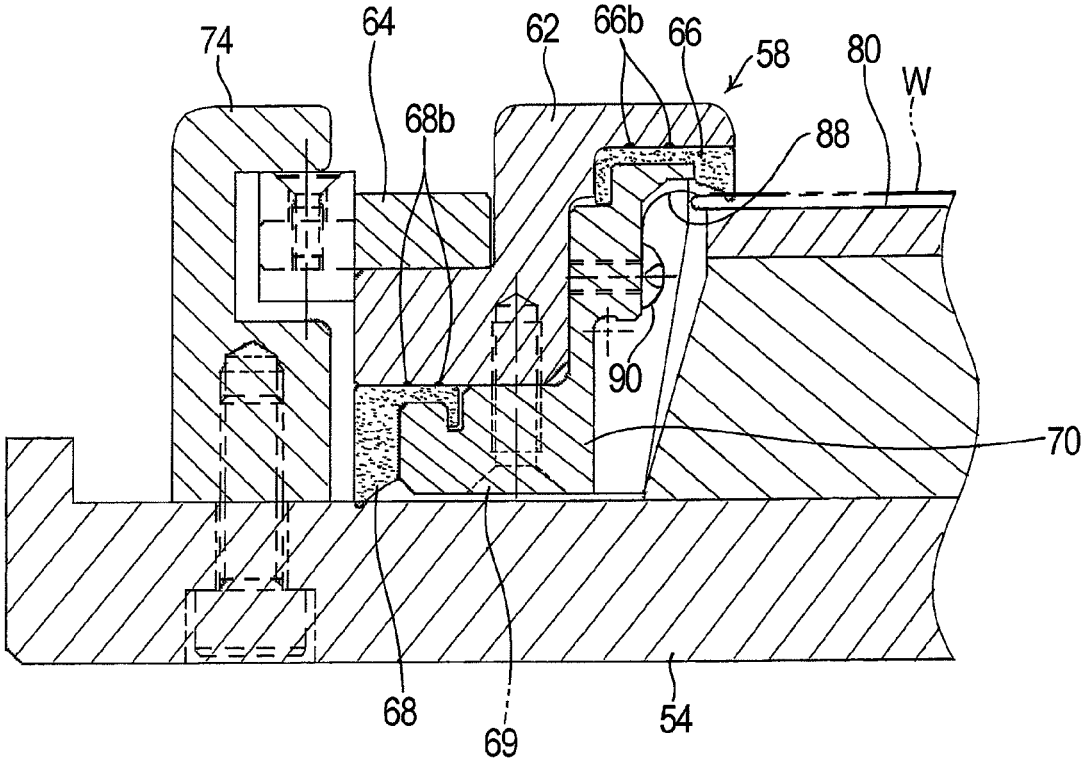
FIG. 11 is an enlarged cross-sectional view of the main portion of a substrate holder according to another embodiment of the present invention.

FIG. 11 is an enlarged cross-sectional view of the main portion of a substrate holder according to another embodiment of the present invention. In this embodiment, two ring-shaped sealing protrusions 66*b* are provided on the contact surface (upper surface) of the inner seal member 66 with the seal holder 62, and two ring-shaped sealing protrusions 68*b* are provided on the contact surface (upper surface) of the outer seal member 68 with the seal holder 62. When the fastening tools (bolts) 69 are tightened, the sealing protrusions 66*b* and the sealing protrusions 68*b* are deformed elastically by the upward movement of the fixing ring 70 toward the seal holder 62. Thus, the connection between the inner seal member 66 and the seal holder 62 is sealed by the sealing protrusions 66*b*, and the connection between the outer seal member 68 and the seal holder 62 is sealed by the sealing protrusions 68*b*.

In this embodiment, the major portion of the inner seal member 66 and the major portion of the outer seal member 68 are fixedly held between the seal holder 62 and the fixing ring 70.

Figure 12:
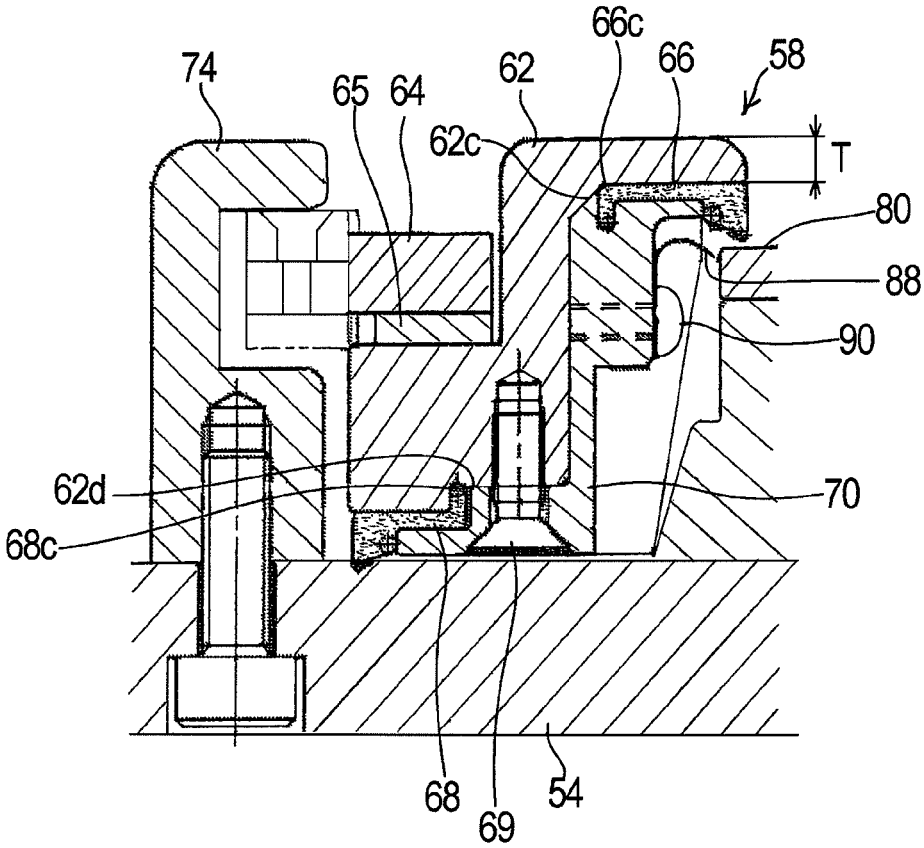
FIG. 12 is an enlarged cross-sectional view of the main portion of a substrate holder according to yet another embodiment of the present invention.

FIG. 12 is an enlarged cross-sectional view of the main portion of a substrate holder according to yet another embodiment of the present invention. In this embodiment, the upper shoulder portion of the outer downwardly-extending portion of the inner seal member 66 serves as a pressure contact portion 66*c* which makes pressure contact with the inclined portion 62*c* of the seal holder 62, and the upper end of the inner upwardly-extending portion of the outer seal member 68 serves as a pressure contact portion 68*c* which makes pressure contact with the horizontal portion 62*d* of the seal holder 62.

In this embodiment, when the fastening tools (bolts) 69 are tightened and the fixing ring 70 moves upwardly toward the seal holder 62, as in the embodiment shown in FIG. 11, the pressure contact portion 66*c* of the inner seal member 66 comes into pressure contact with the inclined portion 62*c* of the seal holder 62, while the pressure contact portion 68*c* of the outer seal member 68 comes into pressure contact with the horizontal portion 62*d* of the seal holder 62. The connection between the seal holder 62 and the inner seal member 66 and the connection between the seal holder 62 and the outer seal member 68 are thus sealed.

According to this embodiment, the thickness T of that portion of the seal holder 62, which lies over and covers the upper surface of the inner seal member 66, can be reduced. This can reduce the weight of the substrate holder 18. Further, by decreasing the thickness of that portion of the substrate holder 18 which projects toward the anode side from the plane of a substrate W held by the substrate holder 18, it becomes possible to dispose a paddle, for example, which stirs a plating solution in a plating tank, closer to the substrate so that the plating solution can be stirred more intensely in the vicinity of the substrate.

Figure 13:
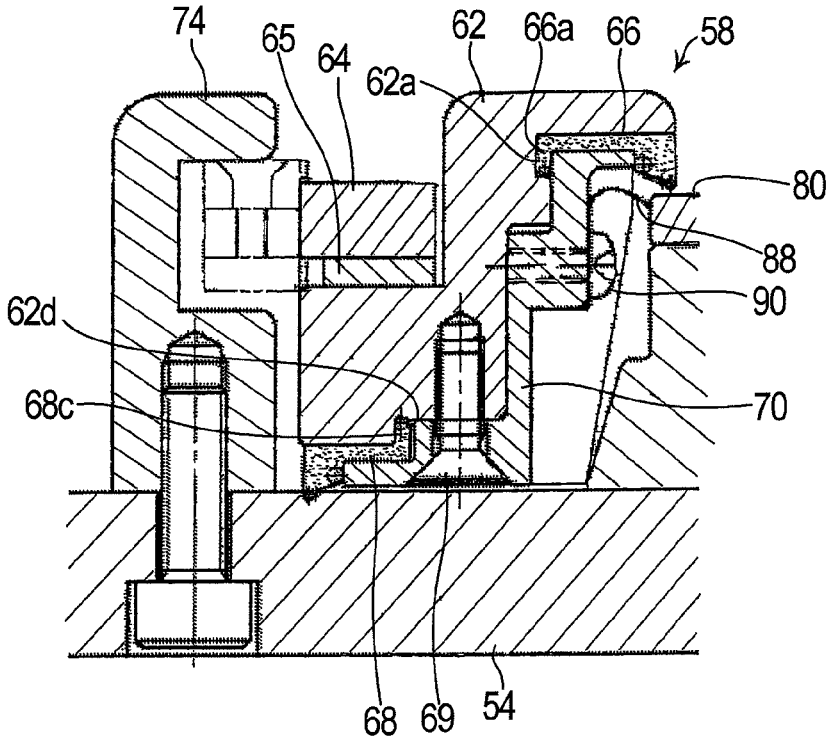
FIG. 13 is an enlarged cross-sectional view of the main portion of a substrate holder according to yet another embodiment of the present invention.

FIG. 13 is an enlarged cross-sectional view of the main portion of a substrate holder according to yet another embodiment of the present invention. In this embodiment, as in the embodiment shown in FIG. 7, the outer projecting portion 66*a* of the inner seal member 66 is fit into the groove 62*a* provided in the seal holder 62, thereby sealing the connection between the seal holder 62 and the inner seal member 66 with the projecting portion 66*a* lying in the groove 62*a*. Further, as in the embodiment shown in FIG. 12, the pressure contact portion 68*c*, provided at the upper end of the inner upwardly-extending portion of the outer seal member 68, is brought into pressure contact with the horizontal portion 62*d* of the seal holder 62, thereby sealing the connection between the seal holder 62 and the outer seal member 68.

Figure 14:
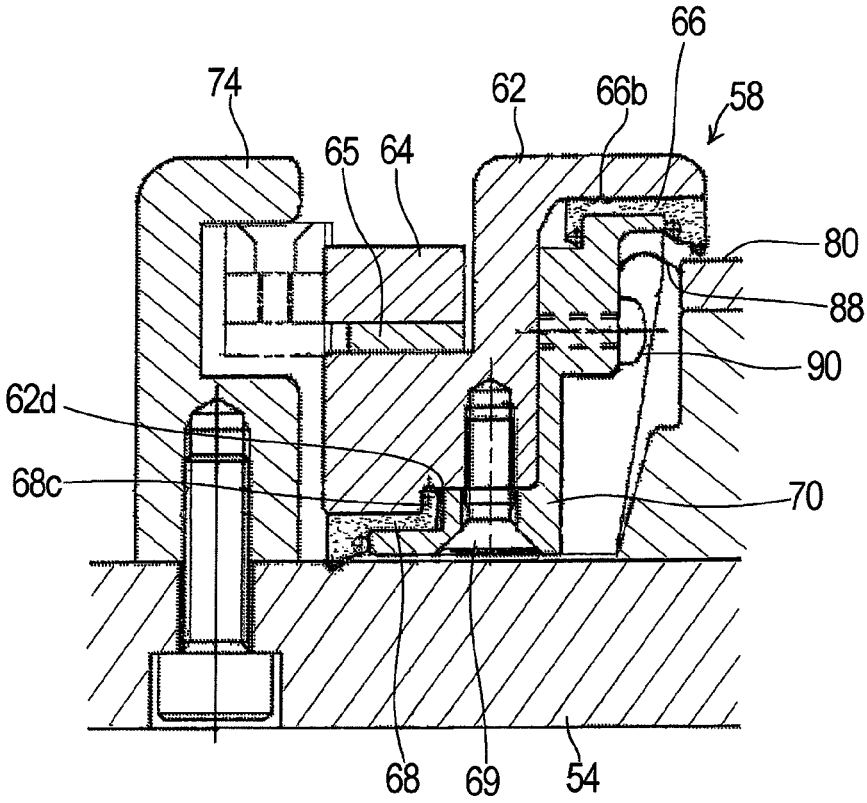
FIG. 14 is an enlarged cross-sectional view of the main portion of a substrate holder according to yet another embodiment of the present invention.

FIG. 14 is an enlarged cross-sectional view of the main portion of a substrate holder according to yet another embodiment of the present invention. In this embodiment, as in the embodiment shown in FIG. 11, the sealing protrusions 66*b*, provided in the contact surface of the inner seal member 66 with the seal holder 62, is brought into pressure contact with the seal holder 62, thereby sealing the connection between the seal holder 62 and the inner seal member 66. Further, as in the embodiment shown in FIG. 12, the pressure contact portion 68*c*, provided at the upper end of the inner upwardly-extending portion of the outer seal member 68, is brought into pressure contact with the horizontal portion 62*d* of the seal holder 62, thereby sealing the connection between the seal holder 62 and the outer seal member 68.

Figure 15:
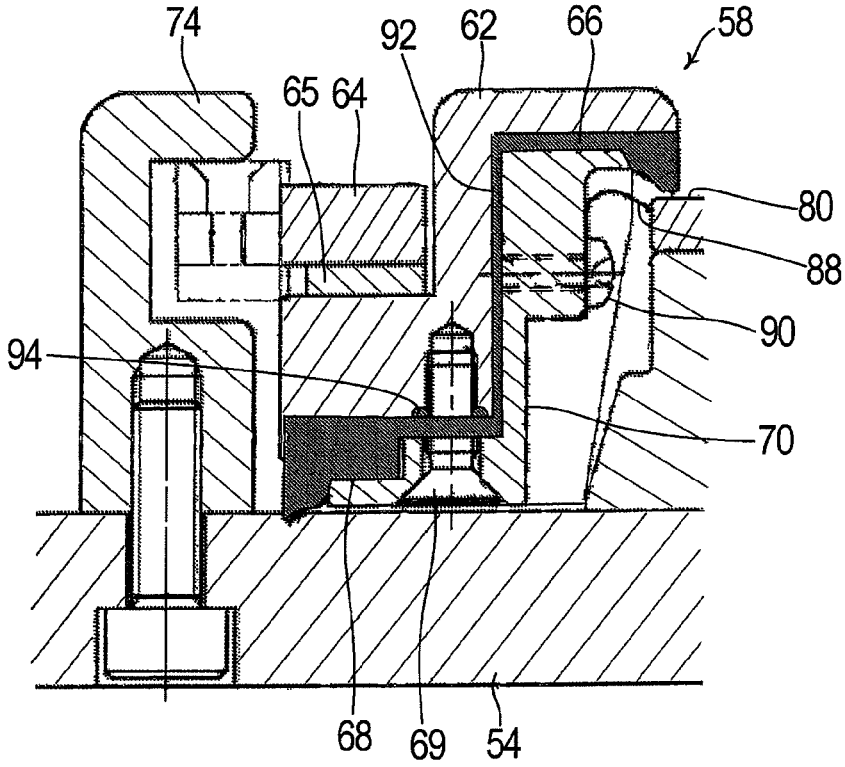
FIG. 15 is an enlarged cross-sectional view of the main portion of a substrate holder according to yet another embodiment of the present invention.

FIG. 15 is an enlarged cross-sectional view of the main portion of a substrate holder according to yet another embodiment of the present invention. In this embodiment, the inner seal member 66 and the outer seal member 68 are integrally formed (i.e., have a one-piece construction) via a cylindrical connecting portion 92 and fixed between the seal holder 62 and the fixing ring 70. A seal ring 94 is provided around each fastening tool 69 to seal a space between an outer surface of the fastening tool 69 and an inner surface of a though-hole that the fastening tool 69 penetrates through.

In the substrate holder 18 in which the inner seal member 66 and the outer seal member 68 are thus formed integrally via the cylindrical connecting portion 92, if a plating solution intrudes into the side of the outer peripheral surface (in contact with the seal holder 62) of the integrated seal member, the plating solution will not intrude into the side of the inner peripheral surface (in contact with the fixing ring 70) of the integrated seal member because the inner peripheral surface side of the integrated seal member is sealed by the pressure contact of the inner seal member 66 with a peripheral portion of a substrate W held by the substrate holder 18 and by the pressure contact of the outer seal member 68 with the fixed holding member 54. Therefore, there is no need to provide a sealing mechanism between the integrated seal member (the inner seal member 66 and the outer seal member 68) and the seal holder 62. This can reduce the number of parts and simplify the structure.

Figure 16:
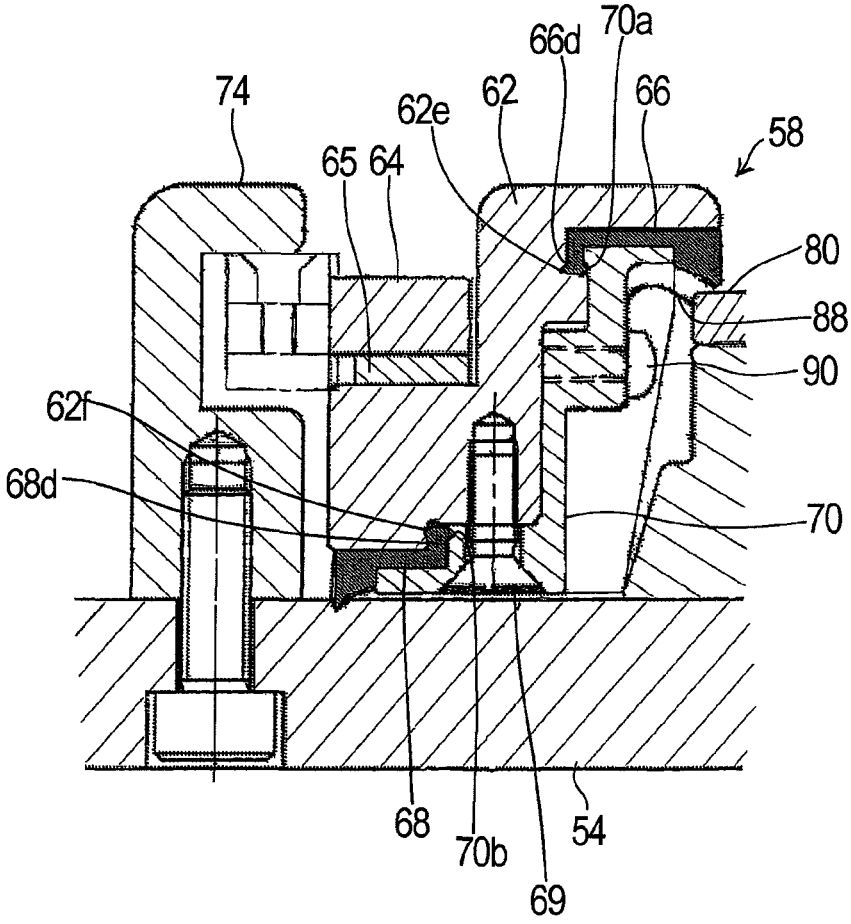
FIG. 16 is an enlarged cross-sectional view of the main portion of a substrate holder according to yet another embodiment of the present invention.

FIG. 16 is an enlarged cross-sectional view of the main portion of a substrate holder according to yet another embodiment of the present invention. In this embodiment, a laterally bulging portion 66*d* is formed at the lower end of the outer downwardly-extending portion of the inner seal member 66. A groove 62*e* is provided in the seal holder 62 at a position corresponding to the laterally bulging portion 66*d*, and a groove 70*a* is provided in the fixing ring 70 at a position corresponding to the laterally bulging portion 66*d*. Similarly, a laterally bulging portion 68*d* is formed at the upper end of the inner upwardly-extending portion of the outer seal member 68. A groove 62*f* is provided in the seal holder 62 at a position corresponding to the laterally bulging portion 68*d*, and a groove 70*b* is provided in the fixing ring 70 at a position corresponding to the laterally bulging portion 68*d*. The connection between the seal holder 62 and the inner seal member 66 is sealed by fitting the laterally bulging portion 66*d* of the inner seal member 66 into the groove 62*e* of the seal holder 62 and the groove 70*a* of the fixing ring 70, while the connection between the seal holder 62 and the outer seal member 68 is sealed by fitting the laterally bulging portion 68*d* of the outer seal member 68 into the groove 62*f* of the seal holder 62 and the groove 70*b* of the fixing ring 70.

In this embodiment, when the inner seal member 66 and the outer seal member 68 are fixed to the seal holder 62 by the fastening tools 69, a vertical force basically does not act on the connection between the seal holder 62 and the inner seal member 66 and on the connection between the seal holder 62 and the outer seal member 68. Accordingly, the number of the fastening tools 69 can be minimized, for example, two to four.

According to this embodiment, as with the embodiment shown in FIG. 12, the thickness T (see FIG. 12) of that portion of the seal holder 62 which lies over and covers the upper surface of the inner seal member 66 can be reduced.

While the present invention has been described with reference to preferred embodiments, it is understood that the present invention is not limited to the embodiments described above, but is capable of various changes and modifications within the scope of the inventive concept as expressed herein.

What is claimed is:

1. A substrate holder comprising:

a first holding member and a second holding member for detachably holding a substrate by gripping a peripheral portion of the substrate between said first holding member and said second holding member;

an inner seal member configured to seal a first gap between said second holding member and the peripheral portion of the substrate;

an outer seal member configured to seal a second gap between said first holding member and said second holding member;

a seal holder to which said inner seal member and said outer seal member are attached; and only one fixing ring located in a sealed space defined when said inner seal member and said outer seal member seal the first gap and the second gap, respectively, said only one fixing ring being configured to press both said inner seal member and said outer seal member against said seal holder, said only one fixing ring contacting said inner seal member and outer seal member.

2. The substrate holder according to claim 1, wherein said seal holder has at least one groove for fitting therein at least one of an outer peripheral portion of said inner seal member and an inner peripheral portion of said outer seal member.

3. The substrate holder according to claim 1, wherein at least one of said inner seal member and said outer seal member has a sealing protrusion on a surface thereof so as to contact said seal holder.

4. The substrate holder according to claim 1, wherein at least one of said inner seal member and said outer seal member has a pressure contact portion configured to be deformed elastically by a tightening force upon fixing of said only one fixing ring to said seal holder so as to create a pressure contact with said seal holder.

5. The substrate holder according to claim 1, wherein said inner seal member and said outer seal member are integrally formed to have a one-piece construction.

6. The substrate holder according to claim 1, further comprising a fastening tool located in the sealed space, said fastening tool being configured to force said only one fixing ring to press said inner seal member and said outer seal member against said seal holder.

7. A plating apparatus comprising:

said substrate holder according to claim 1; and a plating tank for holding a plating solution therein.

* * * * *